US012677872B2

(12) United States Patent
Lee et al.

(10) Patent No.: US 12,677,872 B2
(45) Date of Patent: Jul. 14, 2026

(54) AEROSOL GENERATING APPARATUS AND OPERATION METHOD OF THE SAME

(71) Applicant: KT&G CORPORATION, Daejeon (KR)

(72) Inventors: Won Kyeong Lee, Gyeonggi-do (KR); Heon Jun Jeong, Seoul (KR); Jae Sung Choi, Gyeonggi-do (KR)

(73) Assignee: KT&G Corporation, Daejeon (KR)

( * ) Notice: Subject to any disclaimer, the term of this patent is extended or adjusted under 35 U.S.C. 154(b) by 642 days.

(21) Appl. No.: 17/797,138

(22) PCT Filed: Jan. 27, 2022

(86) PCT No.: PCT/KR2022/001506

§ 371 (c)(1),
(2) Date: Aug. 3, 2022

(87) PCT Pub. No.: WO2022/203188

PCT Pub. Date: Sep. 29, 2022

(65) Prior Publication Data

US 2024/0180242 A1 Jun. 6, 2024

(30) Foreign Application Priority Data

Mar. 25, 2021 (KR) ..... 10-2021-0039153
May 14, 2021 (KR) ..... 10-2021-0062746

(51) Int. Cl.
*A24F 40/05* (2020.01)
*A24F 40/51* (2020.01)
(Continued)

(52) U.S. Cl.
CPC ..... *A24F 40/05* (2020.01); *A24F 40/51* (2020.01); *A24F 40/53* (2020.01); *A24F 40/57* (2020.01);
(Continued)

(58) Field of Classification Search
CPC ..... A24F 40/40; A24F 40/50; A24F 40/51; A24F 40/53; A24F 40/57; A24F 40/05; A24F 40/10; A24F 40/42; A24F 40/60
See application file for complete search history.

(56) References Cited

U.S. PATENT DOCUMENTS 10,021,912 B2 7/2018 Yamada et al.
2014/0278250 A1 9/2014 Smith et al.
(Continued)

FOREIGN PATENT DOCUMENTS

CN 106170214 A 11/2016
CN 106413444 A 2/2017
(Continued)

OTHER PUBLICATIONS

KR20200126588A (Machine Translation) [online], [retrieved on May 2, 2025], retrieved from Google Patents (https://patents.google.com/) (Year: 2020).*
(Continued)

*Primary Examiner* — Philip Y Louie
*Assistant Examiner* — Yana B Krinker
(74) *Attorney, Agent, or Firm* — Foley & Lardner LLP

(57) ABSTRACT

Disclosed is an aerosol generating apparatus including an atomizer configured to generate an aerosol from an aerosol generating material; a controller configured to output a driving voltage for controlling the atomizer; and a voltage divider operationally connected to the controller and configured to control an input voltage of the atomizer by adjusting voltage division of the driving voltage, such that a pre-heating voltage is applied to the atomizer while the atomizer is being pre-heated in a non-puff period and an atomization voltage is applied to the atomizer while the atomizer is atomizing the aerosol generating material in a puff period.

14 Claims, 12 Drawing Sheets

(51) Int. Cl.

| | |
|---|---|
| ***A24F 40/53*** | (2020.01) |
| ***A24F 40/57*** | (2020.01) |
| *A24F 40/10* | (2020.01) |
| *A24F 40/42* | (2020.01) |
| *A24F 40/60* | (2020.01) |

(52) U.S. Cl.
CPC ..... *A24F 40/10* (2020.01); *A24F 40/42* (2020.01); *A24F 40/60* (2020.01)

(56) References Cited

U.S. PATENT DOCUMENTS

| | | | |
|---|---|---|---|
| 2016/0227840 | A1 | 8/2016 | Xiang |
| 2019/0133192 | A1 | 5/2019 | Lord et al. |
| 2020/0120988 | A1 | 4/2020 | Qiu |
| 2020/0212517 | A1 | 7/2020 | Akao et al. |
| 2021/0016028 | A1 | 1/2021 | Cho et al. |
| 2021/0029786 | A1 | 1/2021 | Lee |
| 2021/0030070 | A1 | 2/2021 | Sun et al. |
| 2021/0178093 | A1 | 6/2021 | Frisbee |

FOREIGN PATENT DOCUMENTS

| | | | | | |
|---|---|---|---|---|---|
| CN | 107296301 | A | | 10/2017 | |
| CN | 206586397 | U | | 10/2017 | |
| CN | 108025150 | A | | 5/2018 | |
| CN | 109965362 | A | | 7/2019 | |
| CN | 210672082 | U | | 6/2020 | |
| CN | 111398841 | A | | 7/2020 | |
| CN | 112205676 | A | * | 1/2021 | ..... A24F 40/10 |
| CN | 212464911 | U | | 2/2021 | |
| CN | 112469296 | A | | 3/2021 | |
| EP | 3491948 | A1 | * | 6/2019 | ..... A24B 15/167 |
| EP | 3 491 948 | B1 | | 12/2020 | |
| KR | 10-2017-0095673 | A | | 8/2017 | |
| KR | 20170095673 | A | * | 8/2017 | ..... H02M 3/06 |
| KR | 10-1888281 | B1 | | 8/2018 | |
| KR | 10-2020-0004691 | A | | 1/2020 | |
| KR | 10-2020-0126588 | A | | 11/2020 | |
| KR | 20200126588 | A | * | 11/2020 | ..... A24F 40/50 |

OTHER PUBLICATIONS

KR20170095673A (Machine Translation) [online], [retrieved on May 2, 2025], retrieved from Google Patents (https://patents.google.com/) (Year: 2017).*

Korean Office Action issued May 25, 2023 in Application No. 10-2021-0062746.

Extended European Search Report issued Jun. 13, 2023, in Application No. 22744104.5.

International Search Report of PCT/KR2022/001506 dated May 12, 2022 [PCT/ISA/210].

Written Opinion of PCT/KR2022/001506 dated May 12, 2022 [PCT/ISA/237].

Second Chinese Office Action for Application No. 202280002871.X dated Jan. 21, 2025.

First Office Action on Chinese Application No. 202280002871.X dated Jul. 31, 2024 (20 Pages).

* cited by examiner

AEROSOL GENERATING APPARATUS AND OPERATION METHOD OF THE SAME

CROSS REFERENCE TO RELATED APPLICATIONS

This application is a National Stage of International Application No. PCT/KR2022/001506, filed Jan. 27, 2022, claiming priorities to Korean Patent Application No. 10-2021-0039153, filed Mar. 25, 2021 and Korean Patent Application No. 10-2021-0062746, filed on May 14, 2021.

TECHNICAL FIELD

The present disclosure relates to an aerosol generating apparatus and an operation method of the same, and more particularly, to controlling of an input voltage of an atomizer according to an operation mode of the atomizer.

BACKGROUND ART

Recently, demand for alternatives to traditional cigarettes has increased. For example, there is growing demand for an aerosol generating device that generates an aerosol by heating an aerosol generating material in cigarettes without combustion. In this regard, research on heating type aerosol generating devices and ultrasonic vibration type aerosol generating devices has been actively conducted.

DISCLOSURE

Technical Problem

An ultrasonic vibrating aerosol generating apparatus may facilitate vaporization of a liquid aerosol generating material by lowering the viscosity of the liquid aerosol generating material in contact with an ultrasonic vibrator by using heat generated from the ultrasonic vibrator. In this case, to atomize the liquid aerosol generating material within a short period of time, it is preferable that the viscosity of the liquid aerosol generating material is maintained low.

The present disclosure relates to an aerosol generating apparatus and an operation method thereof. Technical problems to be solved are not limited to the technical problems as described above, and other technical problems may be derived from the below embodiments.

Technical Solution

According to an aspect of the present disclosure, an aerosol generating apparatus includes an atomizer configured to generate an aerosol from an aerosol generating material; a controller configured to output a driving voltage for controlling the atomizer; and a voltage divider operationally connected to the controller and configured to adjust a voltage division of the driving voltage for the atomizer, thereby controlling an input voltage of the atomizer, such that a pre-heating voltage is applied to the atomizer while the atomizer is being pre-heated in a non-puff period and an atomization voltage is applied to the atomizer while the atomizer is atomizing the aerosol generating material in a puff period.

Advantageous Effects

As described above, in an aerosol generating apparatus using a ultrasonic vibrator, the vibrator is maintained in a pre-heated state to lower the viscosity of an aerosol generating material even while a user is not performing a puff such that the aerosol generating material having the low viscosity may be quickly atomized into an aerosol when the vibrator is switched to an atomization operation according to a puff of the user, thereby providing a uniform amount of atomization to the user.

BEST MODE

Figure 1:
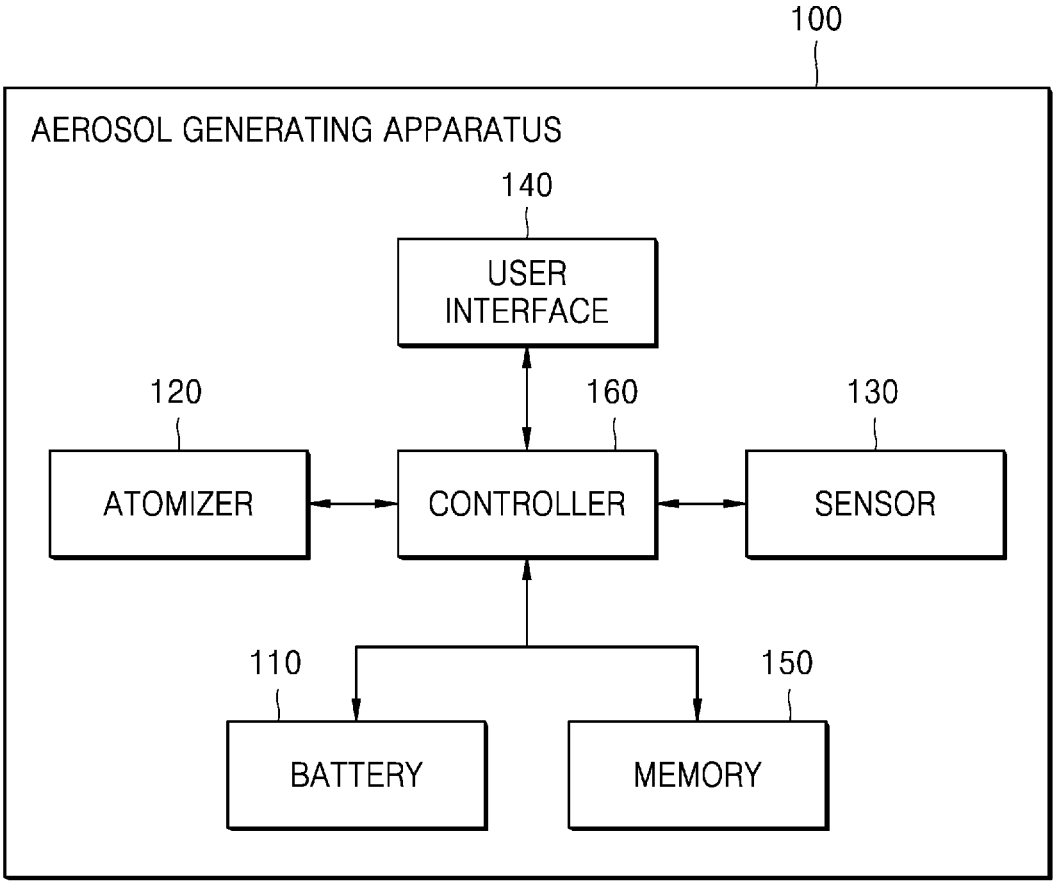
FIG. 1 is a block diagram illustrating hardware components of the aerosol generating apparatus according to an embodiment.

According to an aspect of the present disclosure, an aerosol generating apparatus includes an atomizer configured to generate an aerosol from an aerosol generating material; a controller configured to output a driving voltage for controlling the atomizer; and a voltage divider operationally connected to the controller and configured to control an input voltage of the atomizer by adjusting voltage division of the driving voltage, such that a pre-heating voltage is applied to the atomizer while the atomizer is being pre-heated in a non-puff period and an atomization voltage is applied to the atomizer while the atomizer is atomizing the aerosol generating material in a puff period.

Also, the pre-heating voltage may be a constant voltage lower than the atomization voltage.

Also, the controller may generate a mode signal indicating whether the atomizer is in a pre-heating mode or an atomizing mode, and the voltage divider may perform the voltage division based on the mode signal.

Also, the voltage divider may change connections of loads included in the voltage divider according to a first mode signal corresponding to the pre-heating mode or a second mode signal corresponding to the atomization mode.

Also, the voltage divider may include a first load connected to a node between a voltage output terminal of the controller that outputs the driving voltage and a voltage input terminal of the atomizer; a second load connected in series to the first load; a reference voltage node between the first load and the second load to which a reference voltage is applied from the controller; a third load having one terminal connected to the second load and another terminal connected to a ground; and a switch configured to switch a current flow between the second load and the third load according to a mode signal received from the controller.

Also, the switch may include a semiconductor switch configured to turn on and off a current flow between a source terminal coupled to the ground and a drain terminal coupled to a node between the second load and the third load according to a type of the mode signal received through a gate terminal.

Also, the switch may be turned off in response to a first mode signal corresponding to the pre-heating mode received from the controller, and the voltage divider may apply the pre-heating voltage to the voltage input terminal of the atomizer by blocking a current flow between the source terminal and the drain terminal according to a turn-off state of the switch and dropping the driving voltage at the third load.

Also, the switch may be turned on in response to a second mode signal corresponding to the atomization mode received from the controller, and the voltage divider may apply the atomizing voltage to the voltage input terminal of the atomizer by blocking a current flow to the third load and allowing a current flow between the source terminal and the drain terminal according to a turn-on state of the switch.

Also, a current flow to the third load may be allowed by the switch in the pre-heating mode, and a current flow to the third load may be blocked by the switch in the atomization mode.

Also, due to a voltage drop by the third load in the pre-heating mode, the pre-heating voltage lower than the atomization voltage may be applied to the atomizer.

Also, the atomizer may include a vibrator configured to generate ultrasonic vibration to atomize the aerosol generating material into an aerosol.

Also, the aerosol generating apparatus may further include a puff detecting sensor configured to detect a puff of a user, wherein the controller may control the voltage division of the voltage divider based on whether the puff detecting sensor detects the puff period or the non-puff period.

According to another aspect of the present disclosure, a method of controlling an aerosol generating apparatus, the method includes outputting, by a controller, a driving voltage for driving an atomizer configured to generate an aerosol from an aerosol generating material; and controlling, by a voltage divider operationally coupled to the controller, an input voltage of the atomizer, such that a pre-heating voltage is applied to the atomizer while the atomizer is being pre-heated in a non-puff period and an atomization voltage is applied to the atomizer while the atomizer is atomizing the aerosol generating material in a puff period.

Also, the method may further include generating, by the controller, any one of a first mode signal corresponding to a pre-heating mode and a second mode signal corresponding to an atomization mode, wherein the controlling may include controlling an operation of a switch included in the voltage divider in response to the first mode signal or the second mode signal; adjusting a voltage division of the driving voltage by switching connections of loads included in the voltage divider in response to the operation of the switch; and applying the pre-heat voltage or the atomization voltage as the input voltage to the atomizer based on the adjusted voltage division.

According to another aspect of the present disclosure, an aerosol generating apparatus includes an atomizer configured to generate an aerosol from an aerosol generating material; a controller configured to output a driving voltage for controlling the atomizer; and a voltage divider operationally coupled to the controller and configured to adjust voltage division of the driving voltage for the atomizer by switching between a first voltage division mode for applying a pre-heating voltage to the atomizer and a second voltage division mode for applying an atomization voltage to the atomizer.

MODE FOR INVENTION

With respect to the terms used to describe the various embodiments, general terms which are currently and widely used are selected in consideration of functions of structural elements in the various embodiments. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the embodiments will now be described more fully with reference to the accompanying drawings, in which exemplary embodiments are shown such that one of ordinary skill in the art may easily work the embodiments. The embodiments can, however, be embodied in many different forms and should not be construed as being limited to the embodiments set forth herein.

Hereinafter, embodiments will be described in detail with reference to the drawings.

FIG. 1 is a block diagram illustrating hardware components of the aerosol generating apparatus according to an embodiment.

Referring to FIG. 1, an aerosol generating apparatus 100 may include a battery 110, an atomizer 120, a sensor 130, a user interface 140, a memory 150, and a controller 160. However, the internal hardware structure of the aerosol generating apparatus 100 is not limited to those illustrated in FIG. 1. It will be understood by one of ordinary skill in the art that some of the hardware components shown in FIG. 1 may be omitted or new components may be added according to the design of the aerosol generating apparatus 100.

In an embodiment, the aerosol generating apparatus 100 may include a main body, and, in this case, hardware components included in the aerosol generating apparatus 100 may be located in the main body. In another embodiment, the aerosol generating apparatus 100 may include a main body and a cartridge, and hardware components included in the aerosol generating apparatus 100 may be located distributively in the main body and the cartridge. Alternatively, at least some of hardware components included in the aerosol generating apparatus 100 may be located in the main body and the cartridge, respectively. Hereinafter, an operation of each of the components will be described without being limited to location in a particular space in which the components of the aerosol generating apparatus 100 are located.

The battery 110 supplies electric power used for the aerosol generating apparatus 100 to operate. In other words, the battery 110 may supply power, such that the atomizer 120 may atomize an aerosol generating material. Also, the battery 110 may supply power for operation of other hardware components included in the aerosol generating apparatus 100, that is, the sensor 130, the user interface 140, the memory 150, and the controller 160. The battery 110 may be a rechargeable battery or a disposable battery.

For example, battery 110 may include a nickel-based battery (e.g., a nickel-metal hydride battery or a nickel-cadmium battery), or a lithium-based battery (e.g., a lithium-cobalt battery, a lithium-phosphate battery, a lithium titanate battery, a lithium-ion battery, or a lithium-polymer battery). However, types of the battery 110 that may be used in the aerosol generating apparatus 100 are not limited thereto. If necessary, the battery 110 may include an alkaline battery or a manganese battery.

The atomizer 120 receives power from the battery 110 under the control of the controller 160. The atomizer 120 may receive power from the battery 110 and atomize an aerosol generating material stored in the aerosol generating apparatus 100.

The atomizer 120 may be located in the main body of the aerosol generating apparatus 100. Alternatively, when the aerosol generating apparatus 100 includes a main body and a cartridge, the atomizer 120 may be located in the cartridge or divided into portions and located in the main body and the cartridge. When the atomizer 120 is located in the cartridge, the atomizer 120 may receive power from the battery 110 located in at least one of the main body and the cartridge. Also, when the atomizer 120 is divided into portions and located in the main body and the cartridge, a portion of the atomizer 120 that needs power supply may receive power from the battery 110 located in at least one of the main body and the cartridge.

The atomizer 120 generates an aerosol from an aerosol generating material in the cartridge. An aerosol refers to a suspension in which liquid and/or solid fine particles are dispersed in a gas. Therefore, an aerosol generated from the atomizer 120 may refer to a state in which vaporized particles generated from the aerosol generating material and the air are mixed. For example, the atomizer 120 may transform a phase of an aerosol generating material into a gas phase through vaporization and/or sublimation. Also, the atomizer 120 may generate an aerosol by discharging an aerosol generating material in the liquid state and/or the solid phase as fine particles.

For example, the atomizer 120 may generate an aerosol from an aerosol generating material by using an ultrasonic vibration method. The ultrasonic vibration method may refer to a method of generating an aerosol by atomizing an aerosol generating material with ultrasonic vibration generated by a vibrator.

The aerosol generating apparatus 100 may include at least one sensor 130. A sensing result by the at least one sensor 130 is transmitted to the controller 160, and the controller 160 may control the aerosol generating apparatus 100 to perform various functions such as controlling the operation of the atomizer 120, restricting smoking, determining whether a cartridge (or a cigarette) is inserted, and displaying a notification.

For example, the at least one sensor 130 may include a puff detecting sensor. The puff detecting sensor may detect a user's puff based on any one of a flow change of the air introduced from the outside, a pressure change, and detection of a sound. The puff detecting sensor may detect a start time and an end time of a puff of a user, and the controller 160 may determine a puff period and a non-puff period according to a detected start time and a detected end time of the puff.

Also, the at least one sensor 130 may include a user input sensor. The user input sensor may be a sensor capable of receiving a user input, e.g., a switch, a physical button, or a touch sensor. For example, a touch sensor may be a capacitive sensor capable of detecting an input of a user by detecting a change in capacitance that occurs when the user touches a certain area including a metal material. The controller 160 may determine whether a user input has occurred based on a change in capacitance detected by a capacitive sensor. When a change in capacitance exceeds a preset threshold value, the controller 160 may determine that a user input has occurred.

Also, the at least one sensor 130 may include a motion sensor. Information regarding the movement of the aerosol generating apparatus 100, such as inclination, moving speed, and acceleration of the aerosol generating apparatus 100, may be obtained through the motion sensor. For example, the motion sensor may measure information regarding a state in which the aerosol generating apparatus 100 is moving, a state in which the aerosol generating apparatus 100 is stationary, a state in which the aerosol generating apparatus 100 is tilted at an angle within a certain range for a puff operation, and a state in which the aerosol generating apparatus 100 is tilted at an angle different from the angle for a puff operation between puff operations. The motion sensor may measure motion information regarding the aerosol generating apparatus 100 by using various methods known in the art. For example, the motion sensor may include an acceleration sensor capable of measuring acceleration in 3 directions, that is, an x-axis direction, a y-axis direction, and a z-axis direction, and a gyro sensor capable of measuring angular velocity in the three directions.

Also, the at least one sensor 130 may include a proximity sensor. The proximity sensor refers to a sensor that detects the presence of or a distance to an approaching object or an object existing in the vicinity without a mechanical contact, by using an electromagnetic field or an infrared ray. Thus, the proximity sensor may detect a user approaching the aerosol generating apparatus 100.

Also, the at least one sensor 130 may include a consumable detachment sensor capable of detecting attachment or detachment of a consumable (e.g., a cartridge, a cigarette, etc.) that may be used in the aerosol generating apparatus 100. For example, the consumable detachment sensor may detect whether a consumable is in contact with the aerosol generating apparatus 100 or determine whether the consumable is detached, through an image sensor. Also, the consumable detachment sensor may be an inductance sensor that detects a change in an inductance value of a coil capable of interacting with a marker of a consumable or a capacitance sensor that detects a change in a capacitance value of a capacitor capable of interacting with a marker of a consumable.

Also, the at least one sensor 130 may measure information regarding the surrounding environment of the aerosol generating apparatus 100. For example, the at least one sensor 130 may include a temperature sensor capable of measuring the temperature of the surrounding environment, a humidity sensor capable of measuring the humidity of the surrounding environment, a moisture sensor capable of detecting leakage or immersion of the aerosol generating apparatus 100, an atmospheric pressure sensor capable of measuring the pressure of the surrounding environment, etc.

The sensor 130 provided in the aerosol generating apparatus 100 is not limited to the above-described types and may further include various other sensors. For example, the aerosol generating apparatus 100 may include a fingerprint sensor capable of obtaining fingerprint information from a user's finger for user authentication and security, an iris recognition sensor that analyzes an iris pattern of a pupil, and a vein recognition sensor that detects an amount of infrared absorption of reduced hemoglobin in a vein, a facial recognition sensor that 2-dimensionally or 3-dimensionally recognizes feature points like eyes, a nose, a mouth, and a facial contour, a radio-frequency Identification (RFID) sensor, etc.

In the aerosol generating device 10, only some of various examples of the sensor 130 given above may be selectively implemented. In other words, the aerosol generating apparatus 100 may combine and utilize information sensed by at least one of the above-stated sensors.

The user interface 140 may provide the user with information about the state of the aerosol generating apparatus 100. The user interface 140 may include various interfacing devices, such as a display or a lamp for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and communication interfacing modules for performing wireless communication (for example, Wi-Fi, Wi-Fi direct, Bluetooth, near-field communication (NFC), etc.) with external devices.

However, the aerosol generating apparatus 100 may be implemented by selecting only some of various examples of the user interface 140 given above.

The memory 150 may be a hardware component configured to store various pieces of data processed in the aerosol generating apparatus 100, and the memory 150 may store data processed or to be processed by the controller 160. The memory 150 may include various types of memories, such as random access memory, such as dynamic random access memory (DRAM), static random access memory (SRAM), etc., read-only memory (ROM), electrically erasable programmable read-only memory (EEPROM), etc.

The memory 150 may store an operation time of the aerosol generating apparatus 100, the maximum number of puffs, the current number of puffs, at least one temperature profile, data on a user's smoking pattern, etc.

The controller 160 controls the overall operation of the aerosol generating apparatus 100. The controller 160 may be implemented as an array of a plurality of logic gates or may be implemented as a combination of a microprocessor and a memory in which a program executable in the microprocessor is stored. Also, it may be understood by one of ordinary skill in the art that the controller 160 may be implemented as other types of hardware.

The controller 160 analyzes a result of the sensing by the at least one sensor 130, and controls processes that are to be performed subsequently. For example, the controller 160 may control power supplied to the atomizer 120 so that the operation of the atomizer 120 is started or terminated, based on a result of sensing by the at least one sensor 130. Also, based on a result of sensing by the at least one sensor 130, the controller 160 may control an amount of power supplied to the atomizer 120 and a time period of supplying the power, such that the atomizer 120 generates an appropriate amount of aerosol or remains in a pre-heated state for a certain period of time. Meanwhile, the controller 160 may control a current or a voltage supplied to a vibrator of the atomizer 120, such that the vibrator of the atomizer 120 vibrates at a certain frequency.

In an embodiment, the controller 160 may start the operation of the atomizer 120 after a user input for the aerosol generating apparatus 100 is received. Also, the controller 160 may control the operation of the atomizer 120 after a puff period or a non-puff period of a user is detected by using the puff detecting sensor. Also, the controller 160 may stop supplying power to the atomizer 120 when the number of puffs counted by the puff detecting sensor reaches a pre-set number or when a certain time is elapsed after the operation of the atomizer 120 is started.

The controller 160 may control the user interface 140 based on the result of the sensing by the at least one sensor 130. For example, when the number of puffs reaches the pre-set number after the number of puffs is counted by using the puff detecting sensor, the controller 160 may notify the user by using at least one of a lamp, a motor, or a speaker that the operation of the aerosol generating apparatus 100 will soon be terminated.

Furthermore, although not illustrated in FIG. 1, the aerosol generating apparatus 100 may be included in an aerosol generating system together with a separate cradle. For example, the cradle may be used to charge the battery 110 of the aerosol generating apparatus 100. For example, the aerosol generating apparatus 100 may be supplied with power from a battery of the cradle to charge the battery 110 of the aerosol generating apparatus 100 while being accommodated in an accommodation space of the cradle.

Figure 2:
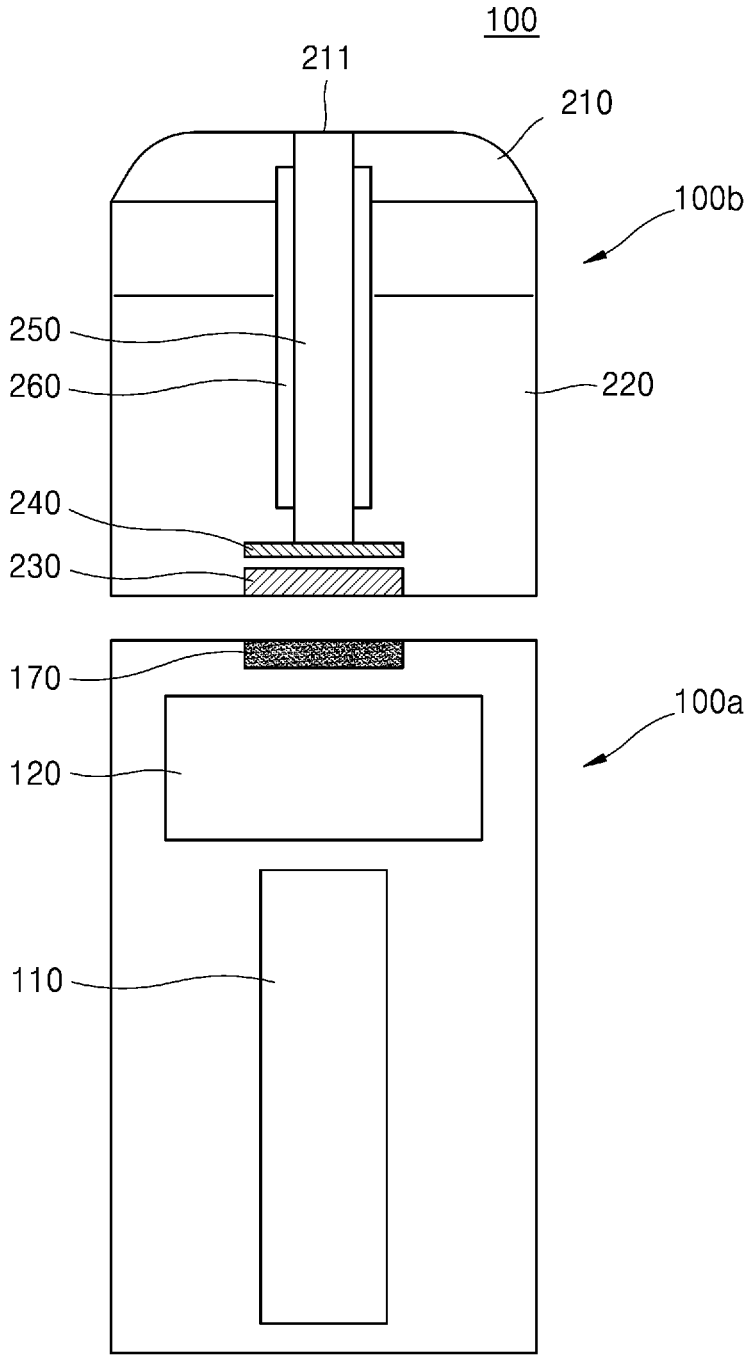
FIG. 2 is a diagram showing the structure of the aerosol generating apparatus of FIG. 1.

FIG. 2 is a diagram showing the structure of the aerosol generating apparatus of FIG. 1.

The aerosol generating apparatus 100 shown in FIG. 1 includes a cartridge **100*b* containing an aerosol generating material and a main body 100*a* supporting the cartridge 100*b***.

The cartridge **100*b* may be coupled to the main body 100*a* in a state in which the aerosol generating material is accommodated therein. For example, a portion of the cartridge 100*b* may be inserted into the main body 100*a* or a portion of the main body 100*a* may be inserted into the cartridge 100*b*, such that the cartridge 100*b* and the main body 100*a* are combined with each other. For example, the main body 100*a* and the cartridge 100*b* may maintain a coupled state by a snap-fit method, a screw coupling method, a magnetic coupling method, a forced coupling method, etc. However, the methods of coupling the main body 100*a* and the cartridge 100*b*** to each other are not limited thereto.

The cartridge **100*b* may include a mouthpiece 210. The mouthpiece 210 may be formed at an end portion of the cartridge 100*b* opposite to the other end portion of the cartridge 100*b* coupled to the main body 100*a*. The mouthpiece 210 may be inserted into a user's oral cavity. The mouthpiece 210 may include a discharge hole 211 for discharging the aerosol generated from the aerosol generating material inside the cartridge 100***b* to the outside.

The cartridge 100*b* may contain an aerosol generating material in any one of, for example, a liquid state, a solid state, a gaseous state, or a gel state. The aerosol generating material may include a liquid composition. For example, the liquid composition may be a liquid including a tobacco-containing material containing volatile tobacco flavor components or may be a liquid including a non-tobacco material.

For example, the liquid composition may include one component of water, solvents, ethanol, plant extracts, spices, flavorings, and vitamin mixtures, or a mixture of these components. The spice may include, but is not limited to, menthol, peppermint, spearmint oil, and various fruit flavoring ingredients. The flavoring may include ingredients capable of providing a user with a variety of flavors. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating apparatus 100, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 100*b* may include a liquid storage 220 containing (i.e., accommodating) an aerosol generating material therein. In other words, the liquid storage 220 may serve as a container for holding an aerosol generating material. To this end, the liquid storage 220 may include therein an element containing an aerosol generating material, such as a sponge, cotton, fabric, or porous ceramic structure.

The aerosol generating apparatus 100 may include an atomizer (120 of FIG. 1) that converts changes phase of the aerosol generating material inside the cartridge 100*b* to generate an aerosol.

The atomizer 120 of the aerosol generating apparatus 100 may change the phase of the aerosol generating material by using an ultrasonic vibration method of atomizing the aerosol generating material with ultrasonic vibration. The atomizer 120 may include a vibrator 170 that generates ultrasonic vibrations, a liquid transmitting unit 240 that absorbs an aerosol generating material and maintains the same in an optimal state for conversion into an aerosol, and a vibration receiving unit 230 for generating an aerosol by transmitting ultrasonic vibrations to the aerosol generating material of the liquid transmitting unit 240.

The vibrator 170 may generate vibration of a short period. The vibration generated by the vibrator 170 may be ultrasonic vibration, and the frequency of the ultrasonic vibration may be, for example, from about 100 kHz to about 3.5 MHz. By the short-period vibration generated by the vibrator 170, the aerosol generating material may be vaporized and/or atomized into an aerosol.

The vibrator 170 may include, for example, a piezoelectric ceramic capable of interconverting an electrical force and a mechanical force by generating electricity (e.g., voltage) in response to a physical force (e.g., pressure) or generating vibration (e.g., mechanical force) in response to electricity. Therefore, vibration is generated by electricity applied to the vibrator 170, and the small physical vibration may split the aerosol generating material into small particles, thereby atomizing the aerosol generating material into an aerosol.

The vibration receiving unit 230 may perform the function of receiving vibration generated by the vibrator 170 and converting the aerosol generating material received from the liquid storage 220 into an aerosol.

The liquid transmitting unit 240 may deliver a liquid composition of the liquid storage 220 to the vibration receiving unit 230. For example, the liquid transmitting unit 240 may be a wick including cotton fiber, ceramic fiber, glass fiber, or porous ceramic, but is not limited thereto.

On the other hand, the atomizer 120 may be implemented as a vibration receiving unit alone, without a separate liquid delivery element. In this case, the vibration receiving unit may have a mesh shape or a plate shape so that an aerosol generating material is absorbed and maintained at the optimal state for conversion into an aerosol. The vibration receiving unit may generate an aerosol by transmitting vibration to the aerosol generating material.

Although FIG. 2 shows that the vibrator 170 of the atomizer 120 is disposed in the main body 100*a*, and the vibration receiving unit 230 and the liquid transmitting unit 240 are arranged in the cartridge 100*b*, the present disclosure is not limited thereto. For example, the cartridge 100*b* may include the vibrator 170, the vibration receiving unit 230, and the liquid transmitting unit 240. In this case, a portion of the cartridge 100*b* is inserted into the main body 100*a*, the main body 100*a* may provide power to the cartridge 100*b* or supply a signal related to the operation of the cartridge 100*b* to the cartridge 100*b* through a terminal (not shown), thereby controlling the operation of the vibrator 170.

At least a portion of the liquid storage 220 of the cartridge 100*b* may include a transparent material so that the aerosol generating material accommodated in the cartridge 100*b* may be visually identified from the outside. The mouthpiece 210 and the liquid storage 220 may be entirely formed of transparent plastic or glass, and only a portion of the liquid storage 220 may be formed of a transparent material.

The cartridge 100*b* of the aerosol generating apparatus 100 may include an aerosol discharging path 250 and an airflow path 260.

The aerosol discharging path 250 may be formed in the liquid storage 220 and may be in fluid communication with the discharge hole 211 of the mouthpiece 210. Therefore, an aerosol generated by the atomizer 120 may move along the aerosol discharging path 250 and may be delivered to a user through the discharge hole 211 of the mouthpiece 210.

The airflow path 260 is a path through which the outside air may be introduced into the aerosol generating apparatus 100. The outside air introduced through the airflow path 260 may flow into the aerosol discharging path 250 or a space in which an aerosol is generated. Therefore, the outside air may be mixed with vaporized particles generated from an aerosol generating material to generate an aerosol.

For example, as shown in FIG. 2, the airflow path 260 may be formed to surround the outside of the aerosol discharging path 250. Therefore, the aerosol discharging path 250 and the airflow path 260 may constitute a double tube shape in which the aerosol discharging path 250 is disposed inside and the airflow path 260 is disposed outside the aerosol discharging path 250. Therefore, the outside air may be introduced through the airflow path 260 in a direction opposite to a direction in which an aerosol moves in the aerosol discharging path 250.

Meanwhile, the airflow path 260 is not limited to the structure described above. For example, the airflow path 260 may be a space formed between the main body 100*a* and the cartridge 100*b* when the main body 100*a* and the cartridge 100*b* are coupled to each other. The airflow path 260 may be in fluid communication with the atomizer 120.

In the aerosol generating apparatus 100 according to the above-described embodiment, the cross section of the aerosol generating apparatus 100 taken perpendicular to the lengthwise direction of the main body 100*a* and the cartridge 100*b* may be approximately circular, oval, square, rectangular, or in various polygonal shapes. However, the cross-sectional shape of the aerosol generating apparatus 100 is not limited to the above-stated shapes, and the aerosol generating apparatus 100 is not necessarily limited to a structure linearly extending in the lengthwise direction. For example, for comfortable grip, the cross-sectional shape of the aerosol generating apparatus 100 may be streamline or may be bent at a certain angle in a specific region. The cross-sectional shape of the aerosol generating apparatus 100 may change along the lengthwise direction.

Hereinafter, a method of controlling the atomizer 120 including the ultrasonic vibrator 170 to provide a constant and uniform amount of atomization to a user in the ultrasonic vibrating aerosol generating apparatus 100 will be described in detail.

Figure 3:
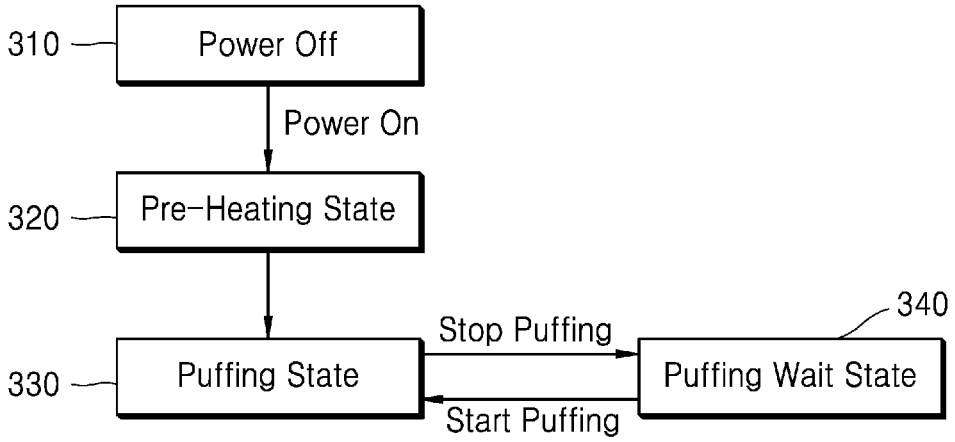
FIG. 3 is a diagram illustrating an operation process of the aerosol generating apparatus according to an embodiment.

FIG. 3 is a diagram for illustrating an operation process of the aerosol generating apparatus according to an embodiment. The operation process shown in FIG. 3 may be a process performed in the aerosol generating apparatus 100 of FIGS. 1 and 2 in time series.

A 'Power Off' 310 may be a state in which a user is not using the aerosol generating apparatus 100 (i.e., a state before the operation of the aerosol generating apparatus 100 is started). For example, the state of 'Power Off' 310 of the aerosol generating apparatus 100 may refer to a sleep mode, a standby mode, or a ship mode. In the 'Power Off' state, although the atomizer 120 is not performing any operation, some sensors may be continuously performing sensing operations. Also, the user interface 140 may be waiting to receive a user input.

When the operation of the aerosol generating apparatus 100 is started by a user input, the aerosol generating apparatus 100 may transition from the state of 'Power Off' 310 to a state of 'Power On'. The state of 'Power On' may refer to a state in which an operation is started as an input voltage is applied to the atomizer 120.

A 'Pre-Heating State' 320 is a state in which the atomizer 120 is being pre-heated to a certain pre-heating temperature as an input voltage (i.e., power) is applied to the atomizer 120. In detail, the 'Pre-Heating State' 320 may be a state before a user performs a first puff. Thus, in the 'Pre-Heating State' 320, although the viscosity of an aerosol generating material is gradually decreasing due to ultrasound vibration by the vibrator 170 of the atomizer 120, atomization of the aerosol generating material has not occurred yet.

When a user starts puffing by using the aerosol generating apparatus 100 after the 'Pre-Heating State' 320 is completed, the aerosol generating apparatus 100 may transition to a 'Puffing State' 330. The 'Puffing State' 330 refers to a state in which an aerosol is generated by ultrasonic vibration of the vibrator 170 of the atomizer 120 and the aerosol is inhaled by the user. In the 'Puffing State' 330, the vibrator 170 of the atomizer 120 may vibrate faster and be at a higher temperature than in the 'Pre-Heating State' 320 such that an aerosol generating material is atomized.

In detail, the vibrator 170 may vibrate and the temperature thereof may rise at the same time. For example, the vibrator 170 may vibrate at a certain vibration speed by converting a part of electrical energy into kinetic energy. The temperature of the aerosol generating material may be controlled by the vibration of the vibrator 170. The vibrator 170 may vibrate in response to a certain voltage having a certain frequency, and as vibration energy is transmitted to the aerosol generating material, the temperature of the aerosol generating material may be changed.

The aerosol generating material may be heated to a certain temperature for generating an aerosol by being vibrated by the vibrator 170. For example, when the aerosol generating material is a liquid material having a certain viscosity, it may be necessary to increase the temperature of the aerosol generating material to a certain temperature to lower the viscosity of the aerosol generating material such that an aerosol is generated. By lowering the viscosity of the aerosol generating material, the time required for atomization by vibration may be shortened, thereby further increasing an amount of atomization.

The vibrator 170 may vibrate at a target vibration speed. The target vibration speed may be a vibration speed pre-set in accordance with various functions and purposes of the aerosol generating apparatus 100. For example, the target vibration speed may be a vibration speed suitable for a pre-heating mode of the vibrator 170 or a vibration speed suitable for an atomization mode for generating an aerosol of an atomization amount desired by a user.

When one puff of a user is ended, the aerosol generating apparatus 100 may transition from the 'Puffing State' 330 to a 'Puffing Wait State' 340. Similar to the 'Pre-Heating State' 320, the 'Puffing Wait State' 340 refers to a state in which the atomizer 120 is being pre-heated to a certain pre-heating temperature. The 'Puffing Wait State' 340 is a state of the atomizer 120 between consecutive puffs of the user. In the 'Puffing Wait State' 340, although a low viscosity of the aerosol generating material is maintained by ultrasonic vibration by the vibrator 170 of the atomizer 120, the aerosol generating material is not being atomized.

When the user starts puff again, the 'Puffing Wait State' 340 may transition back to the 'Puffing State' 330, and the transition between the 'Puffing State' 330 and the 'Puffing Wait State' 340 may be repeated until a pre-set smoking termination condition is satisfied in the aerosol generating apparatus 100. For example, a smoking termination condition may be pre-set based on a threshold number of puffs or a threshold operation time.

When a smoking termination condition is satisfied, the aerosol generating apparatus 100 may transition back to the state of 'Power Off' 310, and thus one smoking session consisting of a series of puffs in the aerosol generating apparatus 100 may be terminated.

The atomizer 120 may be pre-heated under different operation conditions (e.g., different operating frequencies, different input voltages, etc.) when the aerosol generating apparatus 100 is in the 'Puffing State' 330 and in the 'Puffing Wait State' 340 (or the 'Pre-Heating State' 320). In detail, when the aerosol generating apparatus 100 is in the 'Puffing Wait State' 340 (or the 'Pre-Heating State' 320), the atomizer 120 may be operated in the pre-heating mode by a pre-heating voltage. When the aerosol generating apparatus 100 is in the 'Puffing State' 330, the atomizer 120 may be operated in the atomization mode by an atomization voltage.

In this specification, the term 'heating' of the aerosol generating material is not limited to directly transferring heat to the aerosol generating material. For example, the aerosol generating material may be heated by vibration of the atomizer 120 which causes vibration of molecules of the aerosol generating material. Also, heat may be transferred from the atomizer 120 to the aerosol generating material. Meanwhile, the term 'atomization voltage' may be interchangeably used with 'normal heating voltage' or 'normal atomization voltage'. Also, the term 'atomization mode' may be interchangeably used with 'normal heating mode' or 'normal atomization mode'. Also, the terms 'pre-heating mode' and 'pre-heating voltage' may be interchangeably used with 'pre-atomization mode' and 'pre-atomization voltage', respectively.

Figure 4:
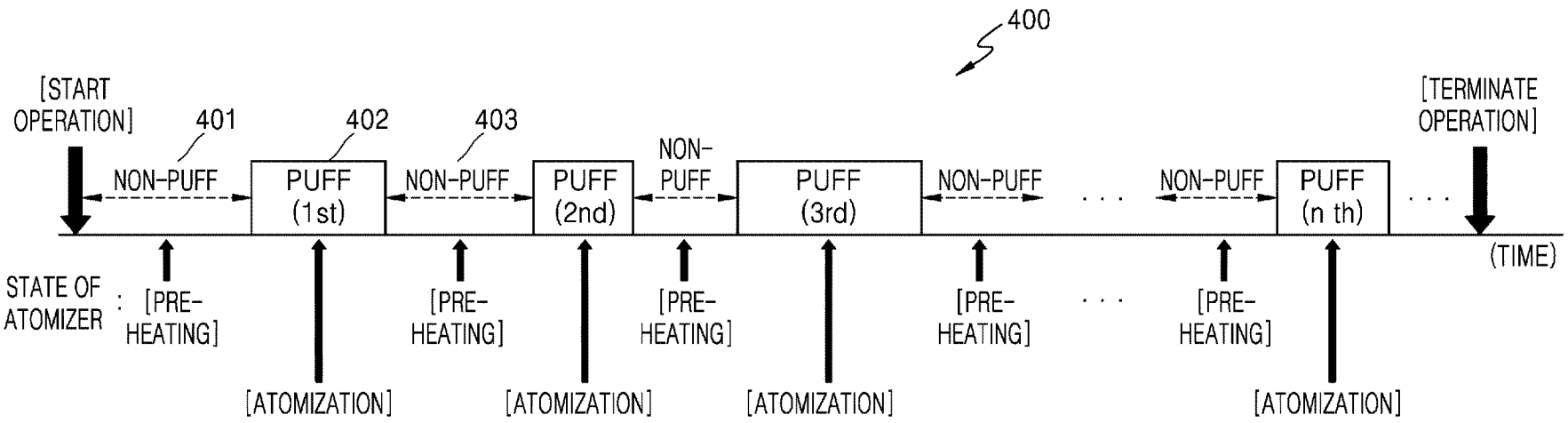
FIG. 4 is a diagram illustrating a puff pattern during a single smoking session using the aerosol generating apparatus according to an embodiment.

FIG. 4 is a diagram illustrating a puff pattern during a single smoking session using the aerosol generating apparatus according to an embodiment. A puff pattern 400 shown in FIG. 4 is merely an example for convenience of explanation of the present embodiments, and a puff pattern using the aerosol generating apparatus 100 may be different from the pattern shown in FIG. 4.

A period during which a user performs a puff may be referred to as a 'puff period', and a period during which the user does not perform a puff between puffs may be referred to as a 'non-puff period'. However, the present disclosure is not limited thereto, and the terms 'puff period' and 'non-puff period' may be replaced with other terms having similar meanings. In the puff pattern 400, the width of a block corresponding to each puff period indicates a relative length of the puff period, and the distance between two blocks indicates a relative length of a non-puff period.

Referring to FIG. 4, after a user starts the operation of the aerosol generating apparatus 100 for smoking, the user may repeatedly perform puffs a certain number of times (e.g., n times) until the smoking session ends.

During a non-puff period 401 between the initiation of the operation of the aerosol generating apparatus 100 and a first puff 402, the atomizer 120 maintains its operation in the pre-heating mode. When the user performs the first puff 402, the state of the atomizer 120 transitions from the pre-heating mode to the atomization mode (or the normal atomization mode), such that the atomizer 120 generates an aerosol and provides it to the user. When the first puff 402 is completed, the atomizer 120 transitions back from the atomization mode to the pre-heating mode, such that the atomizer 120 operates in the pre-heating mode during a non-puff period 403.

The repetition of puff periods and non-puff periods may be performed until the number of puffs counted by a puff detecting sensor reaches a pre-set threshold number of puffs (e.g., n times) or until a certain operation time is elapsed. As described above, the atomizer 120 may perform mode switching between the pre-heating mode and the atomization mode in response to repetition of puff periods and non-puff periods.

The aerosol generating apparatus 100 using the ultrasonic vibrator 170 generates ultrasonic vibration by applying an alternating voltage to the vibrator 170, and an aerosol generating material is vibrated by the vibrator 170 and heated to a temperature for generating an aerosol. In this case, when the aerosol generating material is a liquid material having a certain viscosity, it is preferable to increase the temperature of the aerosol generating material to a certain temperature to lower the viscosity of the aerosol generating material such that an aerosol is generated well.

As the viscosity of the aerosol generating material is maintained low, the atomization time by ultrasonic vibration may be shortened, and thus the aerosol generating apparatus 100 may provide a uniform atomization amount to a user when the user puffs. Therefore, to maintain the viscosity of the aerosol generating material low even when the user is not puffing (i.e., during a non-puff period), the atomizer 120 may perform a pre-heating operation. The 'pre-heating mode' described above is a mode in which the atomizer 120 performs a pre-heating operation during a non-puff period, and the 'atomization mode' is a mode in which the atomizer 120 performs an atomization operation (or a normal atomization operation) during a puff period. Detailed descriptions thereof will be given below with reference to FIG. 5.

Figure 5:
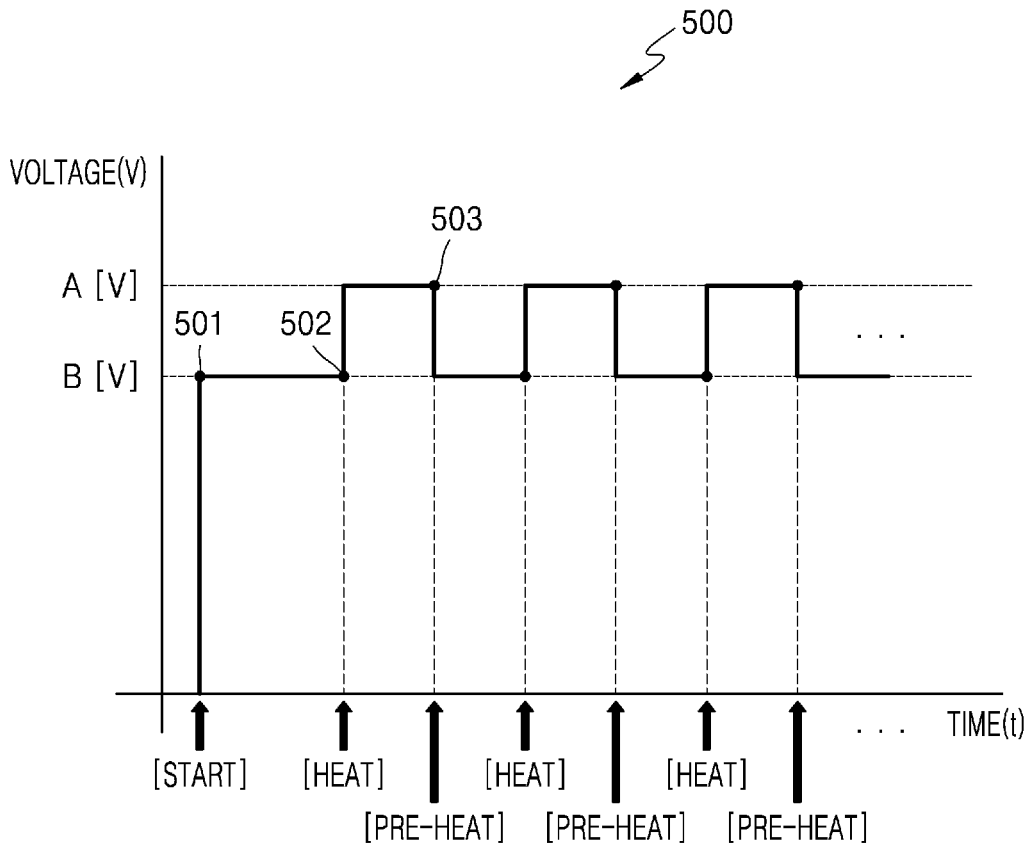
FIG. 5 is a diagram illustrating a voltage profile indicating a change in an input voltage of an atomizer in a pre-heating mode and an atomization mode according to an embodiment.

FIG. 5 is a diagram illustrating a voltage profile indicating a change in an input voltage of an atomizer in a pre-heating mode and an atomization mode according to an embodiment.

Referring to a voltage profile 500 of FIG. 5, in response to an initiation 501 of the operation of the atomizer 120, the atomizer 120 operates in the pre-heating mode, and a pre-heating voltage B [V] may be applied to the atomizer 120 as an input voltage for pre-heating. Thereafter, the atomizer 120 is switched to the atomization mode in response to sensing 502 of a user's puff, and an atomization voltage A [V] may be applied to the atomizer 120 as an input voltage for generating an aerosol.

Here, the atomization voltage A [V] may be a constant voltage of a higher than the pre-heating voltage B [V]. That is, in a case where the atomizing voltage A [V] is applied, the atomizer 120 may be operated at a vibration speed faster than that in a case where the pre-heating voltage B [V] is applied, thereby atomizing an aerosol generating material into an aerosol. On the contrary, the atomizer 120 does not atomize the aerosol generating material when the pre-heating voltage B [V] is applied. In this case, the atomizer 120 only pre-heats the aerosol generating material to a temperature sufficient to maintain the viscosity of the aerosol generating material low. In this way, the low viscosity of the aerosol generating material is maintained low during a pre-heated state, and thus the atomizer 120 may atomize the aerosol generating material more quickly when a next puff is started. As a result, a uniform amount of aerosol may be generated for each puff, and thus a user may feel more satisfactory smoking impression.

When an end 503 of a user puff is detected after the atomization mode, the atomizer 120 may be switched back to the pre-heating mode. In other words, as configured in the voltage profile 500, the input voltage of the atomizer 120 may be repeatedly switched between the atomization voltage A [V] and the pre-heating voltage B [V] according to the switching between the atomization mode and the pre-heating mode.

The aerosol generating apparatus 100 may include a voltage divider that is operationally connected to the controller 160 and controls division of a driving voltage of the controller 160 with respect to the atomizer 120, to adjust the level of the input voltage of the atomizer 120 to the atomization voltage A [V] or the pre-heating voltage B [V].

For example, the atomization voltage A [V] described in FIG. 5 may be 13 [V], and the pre-heating voltage B [V] may be 10 [V]. When the atomization voltage 13 [V] is applied as the input voltage of the atomizer 120, the atomizer 120 may generate an aerosol by boosting the atomization voltage 13 [V] to 65 [V] for an atomization operation of a vibrator (170 of FIG. 2). Also, when the pre-heating voltage 10 [V] is applied as the input voltage of the atomizer 120, the atomizer 120 may maintain the viscosity of the aerosol generating material low by boosting the pre-heating voltage 10 [V] to 60 [V] for a pre-heating operation of the vibrator 170. However, the voltage values described herein are merely examples for convenience of description, and other appropriate voltage values may be used in the present embodiments without being limited thereto.

Figure 6:
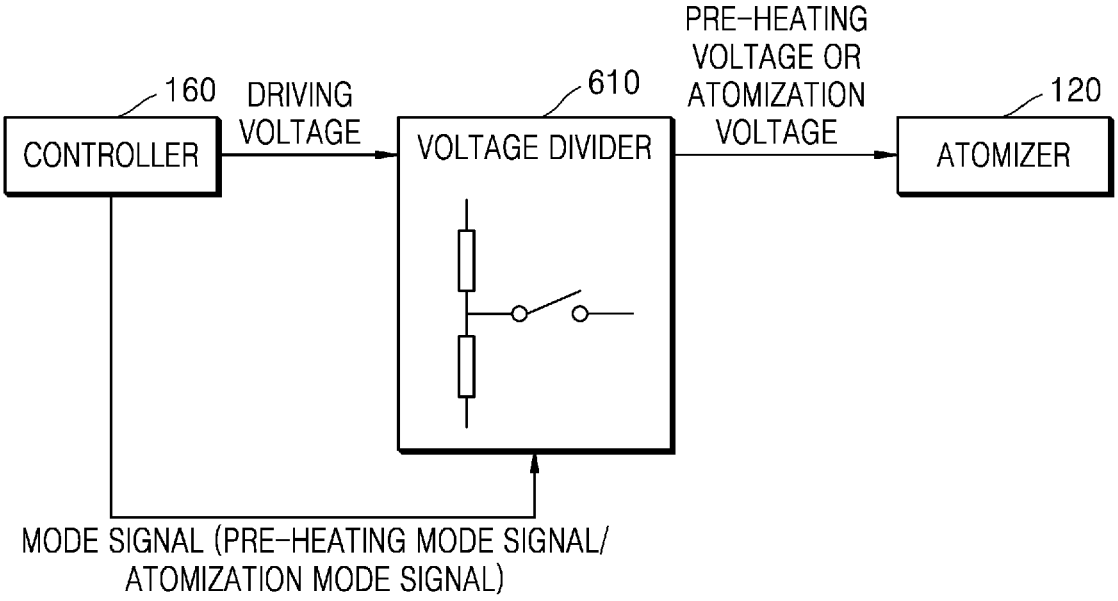
FIG. 6 is a diagram showing a hardware configuration of an aerosol generating apparatus for controlling an input voltage of an atomizer according to an embodiment.

FIG. 6 is a diagram showing a hardware configuration of an aerosol generating apparatus for controlling an input voltage of an atomizer according to an embodiment.

Referring to FIG. 6, an aerosol generating apparatus (e.g., 100 of FIG. 1) may further include a voltage divider 610 connected between the controller 160 and the atomizer 120 described above with reference to FIG. 1.

The controller 160 outputs a driving voltage for controlling the atomizer 120, and the voltage divider 610 applies an input voltage to the atomizer 120 by adjusting a ratio of voltage division regarding the driving voltage. In detail, the voltage divider 610 may be operationally connected to the controller 160 and adjust the voltage division regarding the driving voltage for the atomizer 120, thereby controlling the input voltage of the atomizer 120. Thereby, a pre-heating voltage may be applied to the atomizer 120 while the atomizer 120 is being pre-heated in a non-puff period, and an atomization voltage may be applied to the atomizer 120 while the atomizer 120 is atomizing the aerosol generating material in a puff period.

The voltage divider 610 may receive a mode signal, which is generated by the controller 160 and indicates whether the atomizer 120 is in the pre-heating mode or the atomization mode, from the controller 160. The voltage divider 610 divides a voltage based on the mode signal.

The voltage divider 610 may adjust (or perform) voltage division by switching connections between loads included in the voltage divider 610 according to a pre-heating mode signal (or a first mode signal) corresponding to the pre-heating mode or an atomization mode signal (or a second mode signal) corresponding to the atomization mode, which are received from the controller 160.

A mode signal may be generated by the controller 160 based on a sensing result by a puff detection sensor which indicates a non-puff period or a puff period. In other words, the controller 160 may control the voltage division regarding the voltage divider 610 based on whether the puff detection sensor detects a non-puff period or a puff period.

Meanwhile, the controller 160 may generate a driving voltage based on a supply voltage of a battery (e.g., 110 of FIG. 1). In detail, a DC/DC converter (not shown) for converting the supply voltage of the battery 110 to a certain level may be provided between the battery 110 and the controller 160. For example, the supply voltage of the battery 110 is 4.3 [V] may be converted to 3.3 [V] and may be input to the controller 160. However, the values of the supply voltage of the battery and the input voltage of the controller are merely examples, and the present embodiments are not limited thereto.

In embodiments shown in FIG. 6, the controller 160 and the voltage divider 610 are shown as separate components for convenience of explanation, but the present embodiments are not limited thereto. In other words, the voltage divider 610 may be a component provided in the controller 160 or the atomizer 120, and such modifications are within the scope of the present embodiments.

Figure 7:
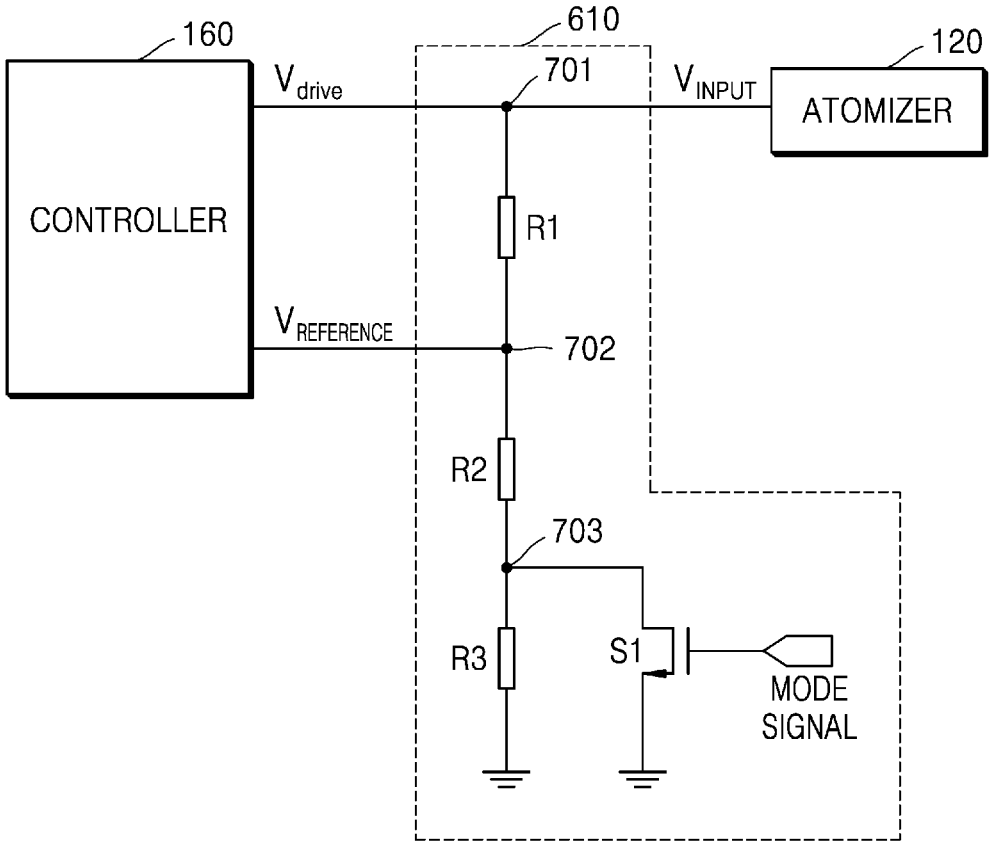
FIG. 7 is a diagram illustrating a voltage divider for controlling an input voltage of an atomizer according to an embodiment.

FIG. 7 is a diagram illustrating a voltage divider for controlling an input voltage of an atomizer according to an embodiment.

Referring to FIG. 7, the voltage divider 610 includes a first load R1, a second load R2, a third load R3, and a switch S1. The first load R1, the second load R2, and the third load R3 are connected in series. The first load R1 is connected to a node 701 between an output terminal of the controller 160 and an input terminal of the atomizer 120. A driving voltage $V_{drive}$ is output from the output terminal of the controller 160, and an input voltage $V_{input}$ is applied to the input terminal of the atomizer 120. A reference voltage $V_{reference}$ is applied to a reference voltage node 702 between the first load R1 and the second load R2. One terminal of the third load R3 is connected to the second load R2 and the other terminal is connected to a ground. The switch S1 switches a current flow between the second load R2 and the third load R3 according to a mode signal received from the controller 160.

The driving voltage $V_{drive}$ output from the controller 160 may be dropped by the first load R1 and the second load R2 or may be dropped by the first load R1, the second load R2, and the third load R3. In other words, the first load R1, the second load R2, and the third load R3 may be implemented as resistors having different resistance values for the voltage drop of the driving voltage $V_{drive}$, but the present disclosure is not limited thereto.

Meanwhile, the voltage division of the driving voltage $V_{drive}$ may be determined by the operation of the switch S1 according to a mode signal. The switch S1 may be implemented as a semiconductor switch including a gate terminal for receiving a mode signal transmitted from the controller 160, a source terminal connected to the ground, and a drain terminal connected to a node 703 between the second load R2 and the third load R3. For example, the switch S1 may be implemented as an N-channel metal-oxide-semiconductor field-effect transistor (MOSFET) as shown in FIG. 7. Therefore, the switch S1 may switch a current flow between the source terminal connected to the ground and the drain terminal connected to the node 703 according to the type of a mode signal received through the gate terminal. According to embodiments, the switch S1 may also be implemented as a P-channel MOSFET or other types of semiconductor switching devices other than an N-channel MOSFET.

The voltage divider 610 shown in FIG. 7 may be implemented with another equivalent circuit for adjusting the input voltage V input of the atomizer 120 according to a mode signal received from the controller 160, and such an equivalent circuit is within the scope of the present embodiments.

Figure 8:
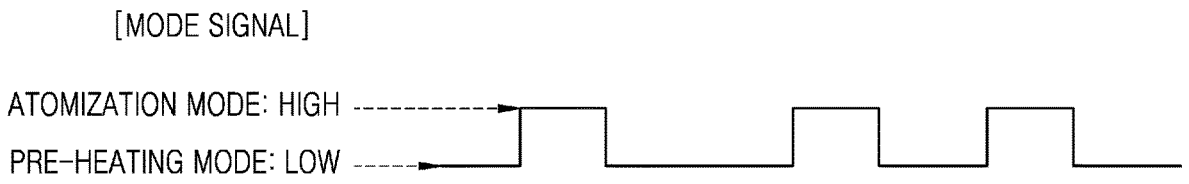
FIG. 8 is a diagram illustrating a mode signal generated by a controller to indicate a pre-heating mode or an atomization mode according to an embodiment.

FIG. 8 is a diagram illustrating a mode signal generated by a controller to indicate a pre-heating mode or an atomization mode according to an embodiment.

Referring to FIG. 8, a signal indicating the pre-heating mode (i.e., pre-heating mode signal) may be a digital signal having a logic value of 0 (LOW), and a signal indicating the atomization mode (i.e., atomization mode signal) may be a digital signal having a logic value of 1 (HIGH). In other words, a mode signal may correspond to a digital pulse signal.

As described above, the controller 160 controls the atomizer 120 to apply an atomization voltage to the atomizer 120 to operate the atomizer 120 in the atomization mode during a puff period and controls the atomizer 120 to apply a pre-heating voltage to the atomizer 120 to operate the atomizer 120 in the pre-heating mode during a non-puff period. Therefore, a pulse period having the logic value of 0 (LOW) may correspond to a non-puff period, and a pulse period having the logical value of 1 (HIGH) may correspond to a puff period.

In detail, the switch S1 described in FIG. 7 is switched to a turn-off state in response to a pre-heating mode signal LOW in the pre-heating mode, and the switch S1 is switched to a turn-on state in response to an atomization mode signal (HIGH) in the atomization mode.

The voltage divider 610 blocks a current flow between the source terminal and the drain terminal according to the turn-off state of the switch S1 and drops the driving voltage $V_{drive}$ at the third load R3, thereby applying the pre-heating voltage to a voltage input terminal of the atomizer 120. On the other hand, the voltage divider 610 blocks a current flow to the third load R3 according to the turn-on state of the switch S1 and allows a current flow between the source terminal and the drain terminal, thereby applying the atomization voltage to the voltage input terminal of the atomizer 120.

On the other hand, the mode signal described in FIG. 8 may only be used in connection with the circuit configuration of the voltage divider 610 described in FIG. 7. When the circuit configuration of the voltage divider 610 is changed, logic values of the mode signal also need to be changed. For example, when the switch S1 of the voltage divider 610 is implemented as a P-channel MOSFET, the mode signal may have logic values opposite to those of FIG. 8.

Figure 9:
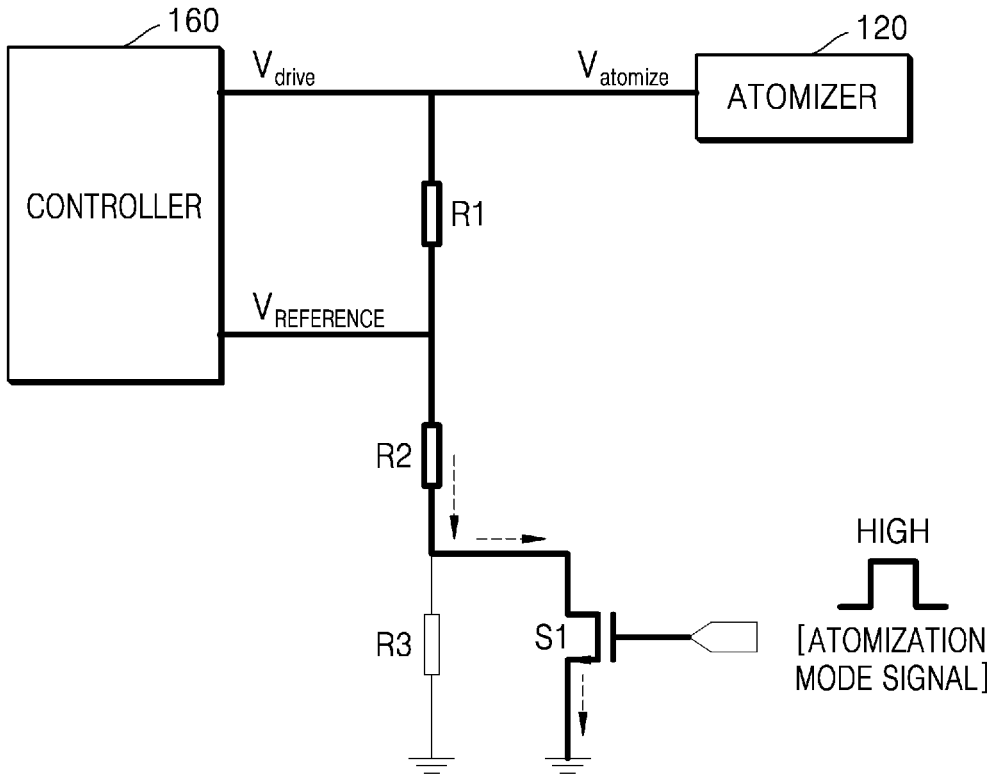
FIG. 9 is a diagram illustrating an atomization voltage division mode of a voltage divider according to an embodiment.

FIG. 9 is a diagram illustrating an atomization voltage division mode of a voltage divider according to an embodiment.

Referring to FIG. 9, the atomization voltage division mode of the voltage divider 610 corresponds to a state in which an atomization mode signal is input to the switch S1 of the voltage divider 610, and the switch S1 is turned on.

In the atomization voltage division mode (or a second voltage division mode) of the voltage divider 610, as one terminal of the second load R2 is connected to the ground through the switch S1 which is in the turn-on state, a current flow to the third load R3 is blocked, and the driving voltage $V_{drive}$ is not dropped at the third load R3. In other words, the driving voltage $V_{drive}$ is dropped by the first load R1 and the second load R2, and thus an atomization voltage $V_{atomize}$ for the atomization mode may be applied to the voltage input terminal of the atomizer 120.

Figure 10:
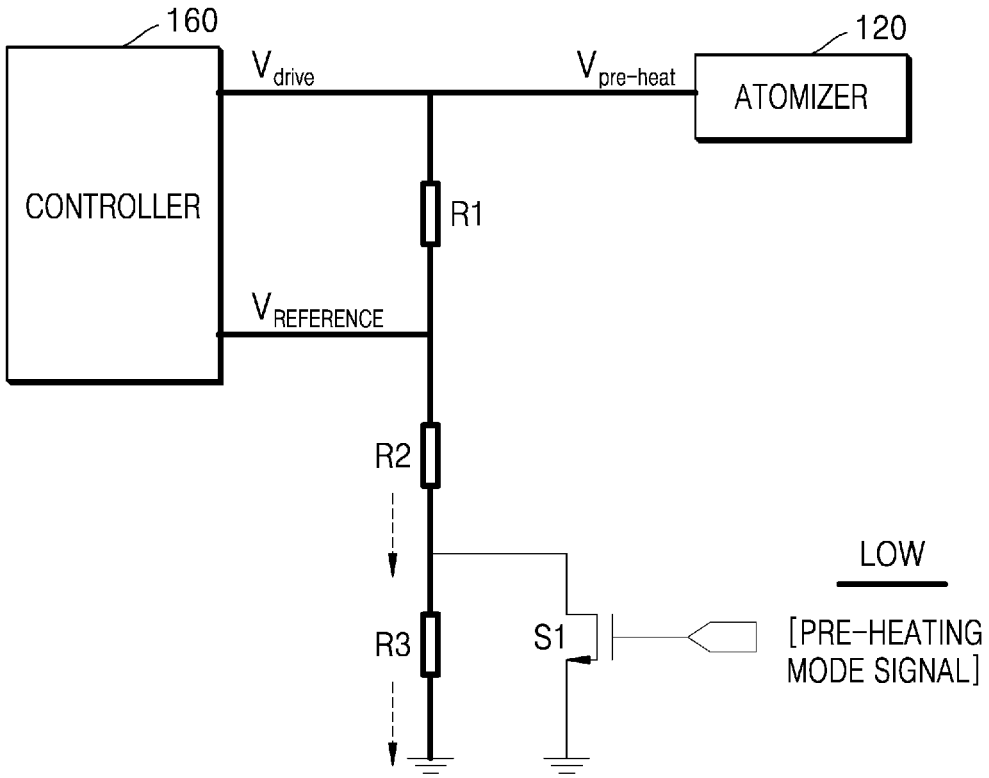
FIG. 10 is a diagram illustrating a pre-heating voltage division mode of a voltage divider according to an embodiment.

FIG. 10 is a diagram illustrating a pre-heating voltage division mode of a voltage divider according to an embodiment.

Referring to FIG. 10, the pre-heating voltage division mode (or a first voltage division mode) of the voltage divider 610 corresponds to a state in which a pre-heating mode signal is input to the switch S1 of the voltage divider 610, and the switch S1 is in the turn-off state.

In the pre-heating voltage division mode of the voltage divider 610, as a current flow through the switch S1 is blocked by the turn-off state of the switch S1, a current flows to the third load R3, and thus the driving voltage $V_{drive}$ is dropped at the third load R3. In other words, the driving voltage $V_{drive}$ is dropped by the first load R1, the second load R2, and the third load R3, and thus a pre-heating voltage $V_{pre\text{-}heat}$ for the pre-heating mode may be applied to the voltage input terminal of the atomizer 120. For example, in the pre-heating voltage division mode of the voltage divider 610, the pre-heating voltage $V_{pre\text{-}heat}$ may be calculated according to Equation 1 below.

$$V_{pre\text{-}heat}=\{R1/(R2+R3)\}*V_{reference}+V_{reference} \quad \text{[Equation 1]}$$

In other words, according to Equation 1, due to an additional voltage drop by the third load R3 in the pre-heating mode, the pre-heating voltage $V_{pre\text{-}heat}$ lower than the atomization voltage $V_{atomize}$ may be applied to the atomizer 120.

Referring to FIGS. 9 and 10, the voltage divider 610 is operationally connected to the controller 160 and is switched between the pre-heating voltage division mode (FIG. 10) for applying the pre-heating voltage $V_{pre\text{-}heat}$ or the atomization voltage division mode (FIG. 9) for applying the atomization voltage $V_{atomize}$ to the atomizer 120, thereby adjusting the driving voltage $V_{drive}$ to the pre-heating voltage $V_{pre\text{-}heat}$ or the atomization voltage $V_{atomize}$ and applying the adjusted voltage to the atomizer 120.

Figure 11:
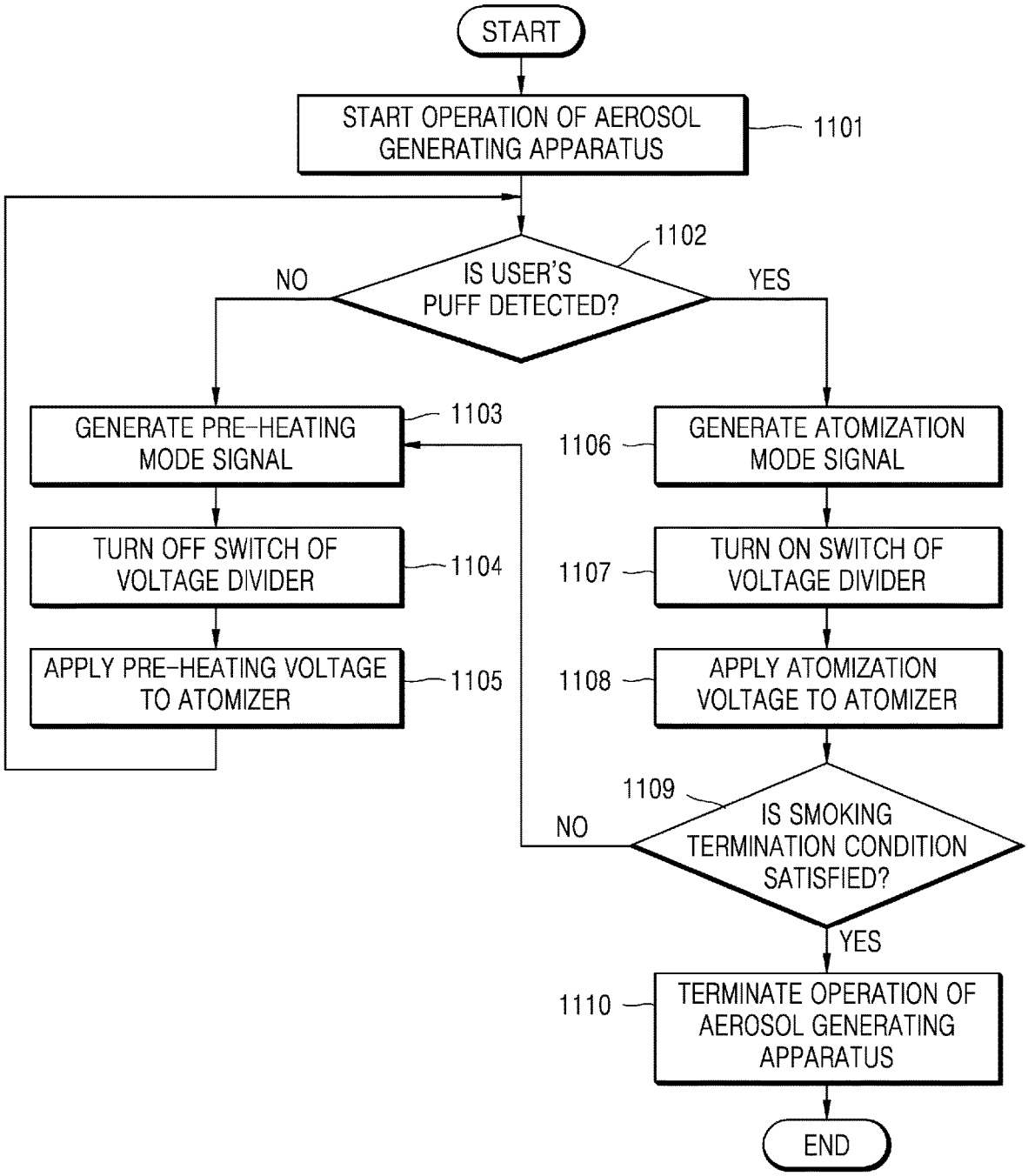
FIG. 11 is a flowchart of a method of controlling an aerosol generating device according to an embodiment.

FIG. 11 is a flowchart of a method of controlling an aerosol generating device according to an embodiment. The method of FIG. 11 corresponds to operations performed in the aerosol generating apparatus 100 described above with reference to FIGS. 1 through 10. Accordingly, even when omitted below, the descriptions given above may be applied to the method of FIG. 11.

In operation 1101, when a user command is input by a user who wants to use the aerosol generating apparatus 100, the operation of the aerosol generating apparatus 100 may be started.

In operation 1102, a puff detecting sensor provided in the aerosol generating apparatus 100 may detect the user's puff. After the operation of the aerosol generating apparatus 100 is started, until the user's puff is sensed, the aerosol generating apparatus 100 may perform operations 1103 to 1105 to perform a pre-heating mode. However, when the user's puff is detected, operation 1106 is performed.

In operation 1103, the controller 160 of the aerosol generating apparatus 100 generates a pre-heating mode signal indicating that the aerosol generating apparatus 100 is in the pre-heating mode. A generated pre-heating mode signal is transmitted to the voltage divider 610 operationally connected to the controller 160.

In operation 1104, the switch S1 of the voltage divider 610 is turned off according to a received pre-heating mode signal, and a current flow through the switch S1 is blocked. Therefore, a current flow to the third load R3 of the voltage divider 610, and thus the driving voltage $V_{drive}$ is dropped at the third load R3.

In operation 1105, the voltage divider 610 applies the pre-heating voltage $V_{pre\text{-}heat}$ to the atomizer 120 based on a voltage drop by loads R1, R2, R3 in the voltage divider 610. Until the puff detecting sensor detects the user's puff (YES in operation 1102), the atomizer 120 maintains the pre-heating mode by the pre-heating voltage $V_{pre\text{-}heat}$.

In operation 1106, when the user's puff is detected, the controller 160 generates an atomization mode signal indicating that the aerosol generating apparatus 100 is in an atomization mode. A generated atomization mode signal is transmitted to the voltage divider 610.

In operation 1107, the switch S1 of the voltage divider 610 is turned on according to a received atomization mode signal, and as one terminal of the second load R2 is connected to the ground through the switch S1, a current flow to the third load R3 is blocked. Therefore, the driving voltage $V_{drive}$ of the voltage divider 610 is dropped at the first load R1 and the second load R2.

In operation 1108, the voltage divider 610 applies the atomization voltage $V_{atomize}$ to the atomizer 120 based on a voltage drop by loads R1 and R2 in the voltage divider 610.

In operation 1109, the controller 160 determines whether a smoking termination condition is satisfied based on the current number of puffs or a current operation time. When the smoking termination condition is satisfied, operation 1110 is performed. However, when the smoking termination condition is not satisfied, operations 1103 to 1105 are performed for the atomizer 120 to enter the pre-heating mode again during a non-puff period.

In operation 1110, when the smoking cessation condition is satisfied, the operation of the aerosol generating apparatus 100 is ended to terminate a smoking operation.

Figure 12:
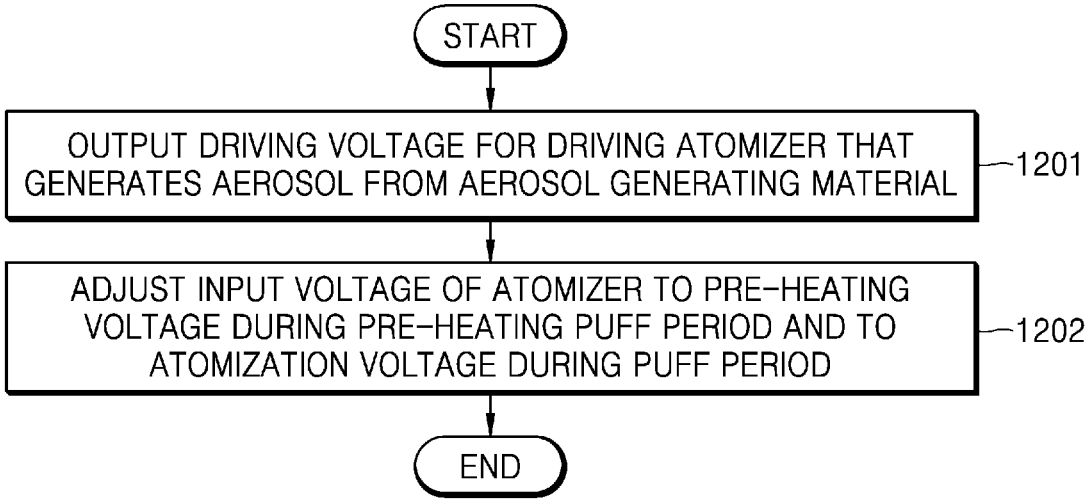
FIG. 12 is a flowchart of a method of controlling an aerosol generating device according to an embodiment.

FIG. 12 is a flowchart of a method of controlling an aerosol generating device according to an embodiment. The method of FIG. 12 corresponds to operations performed in the aerosol generating apparatus 100 described above with reference to FIGS. 1 through 10. Accordingly, even when omitted below, the descriptions given above may be applied to the method of FIG. 12.

In operation 1201, the controller 160 outputs the driving voltage $V_{drive}$ for driving the atomizer 120 that generates an aerosol from an aerosol generating material.

In operation 1202, the voltage divider 610 operationally connected to the controller 160 controls the voltage of the atomizer 120, such that the pre-heating voltage $V_{pre\text{-}heat}$ is applied to the atomizer 120 while the atomizer 120 is being pre-heated in a non-puff period and the atomization voltage $V_{atomize}$ is applied to the atomizer 120 while the atomizer 120 is being heated in a puff period. Here, the controller 160 generates a pre-heating mode signal corresponding to the pre-heating mode or an atomization mode signal corresponding to the atomization mode. The voltage divider 610 controls the operation of the switch S1 included in the voltage divider 610 in response to the pre-heating mode signal or the atomization mode signal. As connections between loads included in the voltage divider 610 are changed in response to the operation of the switch S1, the voltage division of the driving voltage $V_{drive}$ may be adjusted (or performed). The pre-heating voltage $V_{pre\text{-}heat}$ or the atomization voltage $V_{atomize}$ is applied to the atomizer 120 as an input voltage based on the voltage division.

Meanwhile, the method of the present disclosure may be written as computer programs and can be implemented in general-use digital computers that execute the programs using a non-transitory computer readable recording medium. In addition, the structure of the data used in the above-described method may be recorded on a computer-readable recording medium through various means. Examples of the computer readable recording medium include magnetic storage media (e.g., ROM, RAM, USB drives, floppy disks, hard disks, etc.), optical recording media (e.g., CD-ROMs, or DVDs), etc.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. An aerosol generating apparatus comprising:

an atomizer configured to generate an aerosol from an aerosol generating material by using ultrasonic vibration;

a controller configured to output a driving voltage for controlling a frequency of the ultrasonic vibration of the atomizer; and a voltage divider operationally connected to the controller and configured to control an input voltage of the atomizer by adjusting a ratio of voltage division of the driving voltage, such that a pre-heating voltage is applied to the atomizer while the atomizer is being pre-heated in a non-puff period being a period between puff periods and an atomization voltage is applied to the atomizer while the atomizer is atomizing the aerosol generating material in a puff period, wherein the pre-heating voltage is lower than the atomization voltage, and wherein the pre-heating voltage corresponds to an ultrasonic vibration frequency for maintaining the aerosol generating material in a predetermined viscosity state in which atomization of the aerosol generating material does not occur.

2. The aerosol generating apparatus of claim 1, wherein the pre-heating voltage is a constant voltage lower than the atomization voltage.

3. The aerosol generating apparatus of claim 1, wherein the controller generates a mode signal indicating whether the atomizer is in a pre-heating mode or an atomizing mode, and the voltage divider performs the voltage division based on the mode signal.

4. The aerosol generating apparatus of claim 3, wherein the voltage divider changes connections of loads included in the voltage divider according to a first mode signal corresponding to the pre-heating mode or a second mode signal corresponding to the atomization mode.

5. The aerosol generating apparatus of claim 1, wherein the voltage divider comprises:

a first load connected to a node between a voltage output terminal of the controller that outputs the driving voltage and a voltage input terminal of the atomizer;

a second load connected in series to the first load;

a reference voltage node between the first load and the second load to which a reference voltage is applied from the controller;

a third load having one terminal connected to the second load and another terminal connected to a ground; and a switch configured to switch a current flow between the second load and the third load according to a mode signal received from the controller.

6. The aerosol generating apparatus of claim 5, wherein the switch comprises a semiconductor switch configured to turn on and off a current flow between a source terminal coupled to the ground and a drain terminal coupled to a node between the second load and the third load according to a type of the mode signal received through a gate terminal.

7. The aerosol generating apparatus of claim 6, wherein the switch is turned off in response to a first mode signal corresponding to a pre-heating mode received from the controller, and the voltage divider applies the pre-heating voltage to the voltage input terminal of the atomizer by blocking the current flow between the source terminal and the drain terminal according to a turn-off state of the switch and dropping the driving voltage at the third load.

8. The aerosol generating apparatus of claim 6, wherein the switch is turned on in response to a second mode signal corresponding to an atomization mode received from the controller, and the voltage divider applies the atomizing voltage to the voltage input terminal of the atomizer by blocking a current flow to the third load and allowing the current flow between the source terminal and the drain terminal according to a turn-on state of the switch.

9. The aerosol generating apparatus of claim 5, wherein a current flow to the third load is allowed by the switch in a pre-heating mode, and the current flow to the third load is blocked by the switch in an atomization mode.

10. The aerosol generating apparatus of claim 5, wherein, due to a voltage drop by the third load in a pre-heating mode, the pre-heating voltage lower than the atomization voltage is applied to the atomizer.

11. The aerosol generating apparatus of claim 1, wherein the atomizer comprises a vibrator configured to generate the ultrasonic vibration to atomize the aerosol generating material into the aerosol.

12. The aerosol generating apparatus of claim 1, further comprising a puff detecting sensor configured to detect a puff of a user, wherein the controller controls the voltage division of the voltage divider based on whether the puff detecting sensor detects the puff period or the non-puff period.

13. A method of controlling an aerosol generating apparatus, the method comprising:

outputting, by a controller, a driving voltage for controlling a frequency of ultrasonic vibration of an atomizer to generate an aerosol from an aerosol generating material; and controlling, by a voltage divider operationally coupled to the controller, an input voltage of the atomizer by adjusting a ratio of voltage division of the driving voltage, such that a pre-heating voltage is applied to the atomizer while the atomizer is being pre-heated in a non-puff period being a period between puff periods and an atomization voltage is applied to the atomizer while the atomizer is atomizing the aerosol generating material in a puff period, wherein the pre-heating voltage is lower than the atomization voltage, and wherein the pre-heating voltage corresponds to an ultrasonic vibration frequency for maintaining the aerosol generating material in a predetermined viscosity state in which atomization of the aerosol generating material does not occur.

14. The method of claim 13, further comprising generating, by the controller, a first mode signal corresponding to a pre-heating mode or a second mode signal corresponding to an atomization mode, wherein the controlling comprises:

controlling an operation of a switch included in the voltage divider in response to the first mode signal or the second mode signal;

adjusting voltage division of the driving voltage by switching connections of loads included in the voltage divider in response to the operation of the switch; and applying the pre-heat voltage or the atomization voltage as the input voltage to the atomizer based on the adjusted voltage division.

* * * * *